United States Patent [19]

Hohler

[11] 4,259,159

[45] Mar. 31, 1981

[54] METHOD AND APPARATUS FOR SEALING THE CHAMBERS OF COKE OVENS

[75] Inventor: Dieter Hohler, Recklinghausen, Fed. Rep. of Germany

[73] Assignee: Firma Carl Still GmbH & Co. KG, Fed. Rep. of Germany

[21] Appl. No.: 124,088

[22] Filed: Feb. 25, 1980

[30] Foreign Application Priority Data

Mar. 7, 1979 [DE] Fed. Rep. of Germany ..... 2908839

[51] Int. Cl.[3] ..... C10B 29/06

[52] U.S. Cl. ..... 202/269; 52/573; 52/747; 110/336; 202/223; 202/267 R; 202/268

[58] Field of Search ..... 202/220, 222, 223, 267 R, 202/268, 269, 270, 248, 133, 138; 52/204, 573, 747; 110/173 R, 331, 336, 337

[56] References Cited

U.S. PATENT DOCUMENTS

| | | | |
|---|---|---|---|
| 1,099,932 | 6/1914 | Peiter | 202/268 |
| 1,257,113 | 2/1918 | Plantinga | 202/269 |
| 2,098,013 | 11/1937 | Pavitt | 202/268 |
| 2,200,403 | 5/1940 | Van Ackeren | 202/248 |
| 2,772,226 | 11/1956 | Doll | 202/248 |
| 3,146,400 | 6/1965 | Lunt et al. | 52/204 X |
| 3,247,079 | 4/1966 | Wethly | 202/223 X |
| 4,036,702 | 7/1977 | Nagayoshi | 202/248 |

*Primary Examiner*—Frank W. Lutter
*Assistant Examiner*—Roger F. Phillips
*Attorney, Agent, or Firm*—John J. McGlew

[57] ABSTRACT

A device for sealing the cambers of coke ovens adjacent the roof of the oven and above an oven door frame which is located at the transition between fireclay brickwork and silica brickwork each of which has joints between the courses thereof is located between anchor plates which support each side of the door frame. The door frame includes a vertical back portion which intersects a horizontal top portion. During the formation of the brick a cast iron bridge is positioned so that a vertical part is arranged directly behind the door and is advantageously sealed to the rear base of the door frame by a gasket or asbestos cord. The anchor plate carries an upper horizontal portion which is disposed beneath the fireclay brick at the transition between the fireclay and the silica brickwork and supports the fireclay brick. In addition, another horizontally extending part of the cast iron bridge is positioned into the silica brickwork between adjacent courses located near the top of such brickwork. The oven is advantageously constructed also with one or more T-girders which are arranged in the courses in the fireclay brick and in addition at the top of the oven roof an angle iron is positioned on the top of the course of the fireclay brick.

9 Claims, 4 Drawing Figures

METHOD AND APPARATUS FOR SEALING THE CHAMBERS OF COKE OVENS

FIELD AND BACKGROUND OF THE INVENTION

The invention relates in general to coke ovens and in particular to a new and useful device for sealing the chambers of coke ovens in the range of the oven roof above the doors at the transition from the silica brickwork to the fireclay brickwork.

In today's conventional construction of coke ovens, the brickwork of the oven chambers consists mostly of silica bricks, which show a favorable low expansion behavior at the normal application temperatures of 1000° to 1400° C. Above the oven chambers proper no silica material is used anymore in the range of the oven roof, and particularly at the port ends, because of the great temperature fluctuations and the altogether much lower temperatures, since it would no longer withstand the alternating stresses. Instead fireclay material is used as a rule, which is much better and cheaper for the low temperatures prevailing in the range of the roof and of the upper port ends. But as it can be seen particularly for the thermal expansion curves (see Grossinsky, Handbuch des Kokereiwesens, vol. 1, Dusseldorf 1965, p. 228 ff) the elongation is different in the two materials. Silica material shows at the temperatures appearing in the coke ovens an about 0.7% higher thermal expansion than fireclay material. This fact is already taken into account in the construction of coke ovens by providing a so-called "silica rebound" relative to the fireclay brickwork, which is normally compensated during the heating up of the ovens by the different elongation. But it cannot be prevented in practice that cracks and open joints appear with this different expansion behavior in the fireclay brickwork with its lesser expansion applied on the silica brickwork, due to the greater expansion of the silica bricks. Attempts have been made to prevent possible leaks with the resulting later gas emissions during the heating by the application of tie rods and by subsequent closing of the openings by casting.

A particularly critical point at which emission of the crude gases occur, again and again during the operation, is at the silica-fireclay boundary in the range of the port ends above the door frame, where the greatest displacement of the two brick materials relative to each other takes place in a horizontal direction. On the other hand, the brickwork grows at this point by more than 1% in the vertical direction relative to the door frame in front of it with the armor, which are already inserted into the brickwork in the cold state, and relative to the bricks arranged directly above the frame.

The sealing of the brickwork from the outside was effected heretofore only by a protective wall plate which is arranged vertically above the frame in front of the brickwork. The oven is thus covered neatly from the outside, but leaks may be caused in the inner refractory region by the displacement of the brickwork in at least two directions. The result is that the points at which crude gases can escape from the oven block are difficult to seal because it is difficult to get to the points inside the oven. Besides, the protective wall plates as a connection between two buckstays extend from one heating wall to the other, so that the brickwork surfaces that cannot be reached from the outside are rather large.

It is also frequently necessary to correct the position of these protective wall plates during the heating period, because they slip up during the displacement of the brickwork parts or do not remain exactly in a vertical position. Irregularities in the brickwork like oblique bricks or cavities cannot be eliminated, however.

In order to avoid the problems of the different expansion during heating, it has been frequently tried to brick up a part of the roof brickwork, particularly at the ports above the door frame, only after the main expansion of the brick material is completed. But this involves additional difficulties, because the bricks, which have been inserted cold, are easily destroyed by the temperature shock and because the working conditions on the hot oven battery are much less favorable. Besides, the subsequent installation of the bricks considerably delays the further construction and assembly work.

From U.S. Pat. No. 1,029,798 are known port linings for the walls of horizontal chamber ovens where iron protective wall plates are provided between the buckstays and the oven brickwork, and tin plates less brick layers are arranged one above the other between the oven brickwork and the protective wall plates or frame wings, which are secured on the brickwork by pins protruding into the brick joints. These tin plates facilitates only a sliding motion in a vertical direction between protective wall plate and brickwork, but provide no gastight seal. With different expansions in horizontal direction, such a sliding motion is hindered causing the above mentioned cracks in the brickwork.

SUMMARY OF THE INVENTION

The invention provides a simpler sealing of the refractory brickwork at the upper silica-fireclay boundary, which compensates effectively the different expansion of the brickwork during the heating and the operation of the coke ovens and which facilitates the construction and repair of the brickwork of coke ovens.

The solution according to the invention comprises arranging a cast-iron bridge extending horizontally from one buckstay to the other and including a multi-arm angle section with the central vertical part behind the upper terminal edge of the door frame following its profile and ahead of the silica brickwork, whereby an upper horizontal arm extends to the outside over the door frame and carries the port brickwork, and the upper edge is flush with the silica-fireclay brickwork, and a second horizontal arm is inserted to the inside into one of the top joints of the silica brickwork.

By means of this bridge we have iron surfaces of the bridge and of the door frame which bear tightly on each other and which can be displaced relative to each other in vertical direction. In addition the bridge is rigidly connected by the inner arm with the bottom silica brickwork with the greater expansion. In addition, the horizontal displacement between silica and fireclay brickwork can readily take place on the upper outwardly directed arm.

The fireclay inserts above the bridge are held in a known manner by means of one or more section irons with adjustable springs and by the buckstays, which in turn are protected against deflection to the outside by tie rods extending over the battery.

It was furthermore found to be expedient in the design according to the invention to insert one or more flexible gaskets in recesses of the frame and/or of the bridge to obtain a perfect gastight seal. This seal can be a cord of asbestos or any other heat-resistant sealing material. The gasket cord is kept exactly in its provided position by the recess, even during its sliding motion.

Leaks between the brickwork, appearing after heating and during the operation, can be easily located, are readily accessible, and can be repaired rapidly by the sealing device according to the invention.

By using the invention it is now possible to finish the entire refractory brickwork, even the upper fireclay layers, during the construction of the battery before the tie rods, buckstays and frames are assembled. In this way, difficulties, which always appeared in the past in the construction of coke oven batteries, are avoided.

Another advantage of this bridge is that, if it becomes necessary to replace the entire door frame, this can be done without risk and without bricks falling out, since the bricks above the door frame are held by the upper horizontal arm of the bridge.

Accordingly, it is an object of the invention to provide a method of constructing a coke oven in the area adjacent the roof of the coke oven and above a door frame particularly at the boundary between a silica brickwork and a fireclay brickwork which comprises inserting a bridge between the door frame and in a position such that a horizontal top portion thereof supports the fireclay brickwork thereabove and a lower horizontal portion spaced downwardly therefrom engages into a course of the silica brickwork and supports it and wherein the bridge is advantageously positioned so that a vertical portion extends behind the door frame and, for example, may be sealed therewith by asbestos gasket elements.

A further object of the invention is to provide a device for sealing the chambers of coke ovens adjacent the roof of the oven above an oven door frame at the transition between fireclay brickwork and silica brickwork each of which brickwork has joints between the courses thereof and in which the door frame includes a vertical back portion and a horizontal top portion and a buckstay on each side for supporting the door frame which comprises a cast iron bridge extending horizontally between the buckstays and including a central vertical part disposed behind the vertical edge of the door frame and extending thereabove and having a horizontal upper part which is positioned below and supports the fireclay brickwork at the transition between the fireclay brickwork and the silica brickwork and has a lower horizontal part extending between and engaged in the courses of the silica brickwork.

A further object of the invention is to provide a coke oven construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

Figure 1:
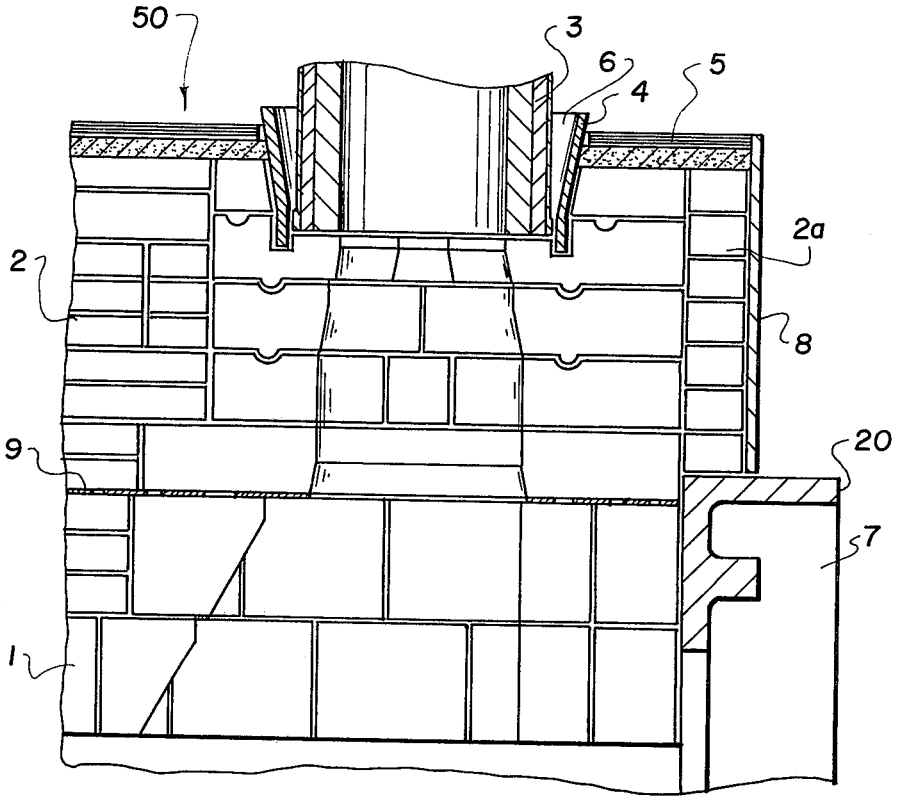
FIG. 1 (PRIOR ART)
FIG. 1 is a partial elevational and partial sectional view of a coke oven adjacent the roof thereof constructed in accordance with the prior art.

Referring to the prior art shown in FIG. 1, there is provided a coke oven generally designated 50 which includes a roof structure adjacent the top thereof having an uptake 3 which is engaged in an opening 4 with sealant 6 therearound. The top of the oven is formed with the usual brick and finishing materials 5. Such coke ovens have usually a brickwork 1 adjacent a door frame structure 7 which comprises a silica brickwork and a brickwork comprising a fireclay brickwork 2 arranged above the silica brickwork and over a silica brickwork and fireclay brickwork boundary 9. With such a construction a protective plate 8 is arranged above a top horizontal surface 30 of the door frame 7 and it is noted that each brickwork comprises bricks of various shapes.

According to FIG. 1, the entire end portion of the oven is covered above door frame 7 with a protective wall plate 8.

The silica fireclay boundary 9 ends covered behind the frame at a poorly accessible point (not shown). The representation in FIG. 1 is considered a desirable ideal state after heating up of the brickwork, because the silica and firecly bricks 1 and 2 respectively bear tightly behind protective wall plate 8 and door frame 7, and the brickwork would be tightly sealed in this case.

In practice, however, this is mostly not the case, and can only be achieved incompletely by subsequent elaborate sealing measures.

FIG. 1 shows clearly that the first brick row **2*a* behind protective wall plate 8 is not joined with the other inner brickwork 2, because it rests on door frame 7** and moves in vertical direction with the latter differently than the inner brickwork.

Figure 2:
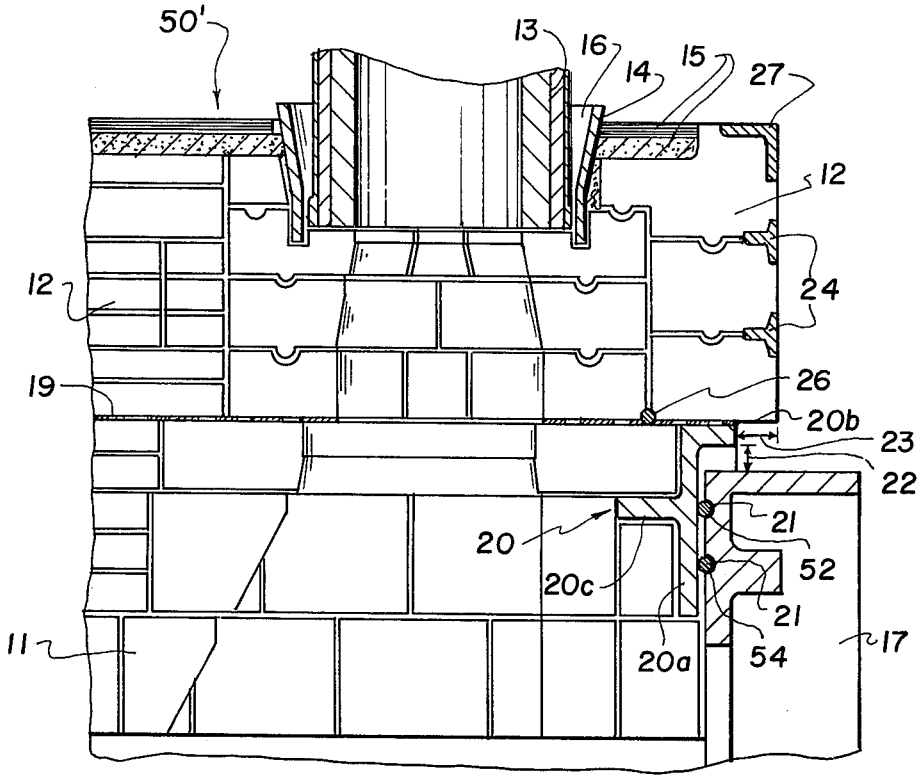
FIG. 2 is a view similar to FIG. 1 showing a coke oven constructed in accordance with the invention.
Figure 3:
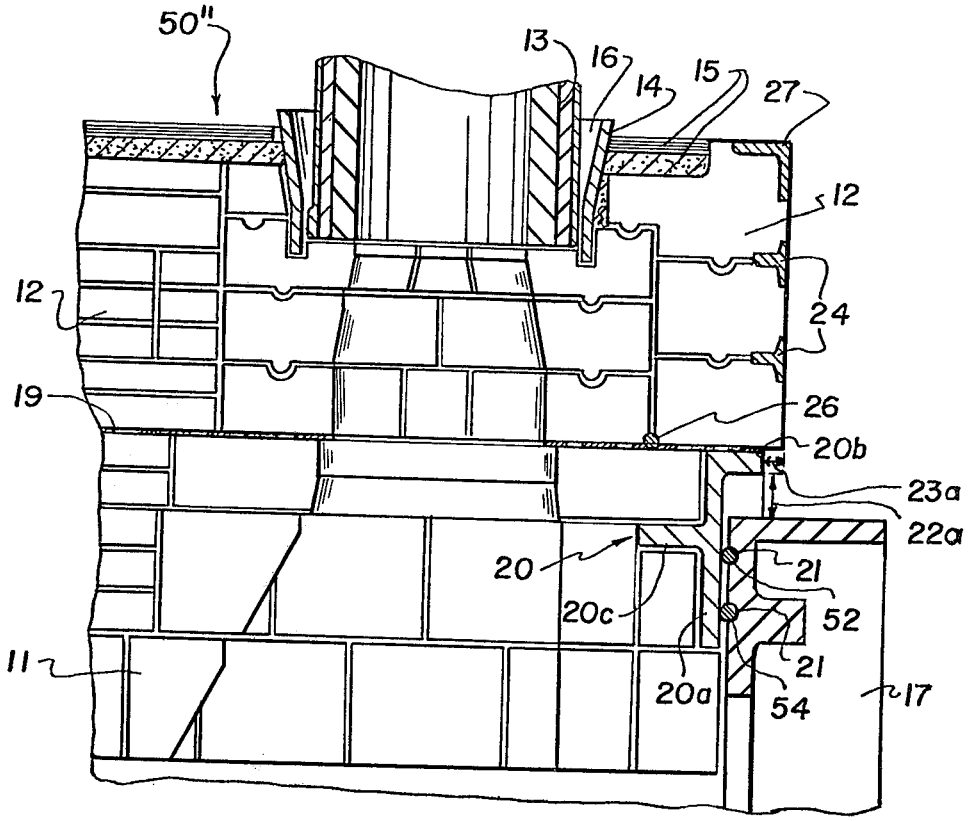
FIG. 3 is a view similar to FIG. 2 of another embodiment of the invention.

The silica fireclay boundary 19 is designed in the arrangement according to the invention (FIGS. 2 and 3) in coke ovens 50' and 50'' as a continuous slip joint in the longitudinal direction of the oven, which extends exactly above a bridge generally designated 20 in front of silica brickwork 11. The displacement of the bridge 20, and thus of silica brickwork 11 becomes clear by a comparison of FIGS. 2 and 3. In FIG. 2, the distance or spacing 22 is small, and the distance or spacing 23 is great before heating up. After heating up, brickwork 11 and 12 have grown relative to frame 17 by the difference of the distances **22*a* and 22 in vertical direction. Likewise silica brickwork 11 with bridge 20 has expanded further to the outside by the difference of the distance 23 and 23*a* relative to fireclay brickwork 12 in horizontal direction. The distances 22, 22*a*, 23, 23*a*** can be easily checked from the outside during the heating up period and the subsequent operation.

In order to have a truly gastight seal at the sliding surfaces too, an asbestos cord 21 is inserted in recess 52 and 54 between bridge 20 and frame 17, which also evens out minor unevenesses. A gasket cord 26 has already been inserted into the outer butt joint at the silica fireclay boundary.

Above door frame 17, protective wall plate 8 can be eliminated in the design according to the invention and instead T-girders 24 can be inserted in front of fireclay brickwork 12 or with the single arm into the joints of the brickwork. The top brick layer is held in this case by an angle iron 27.

Figure 4:
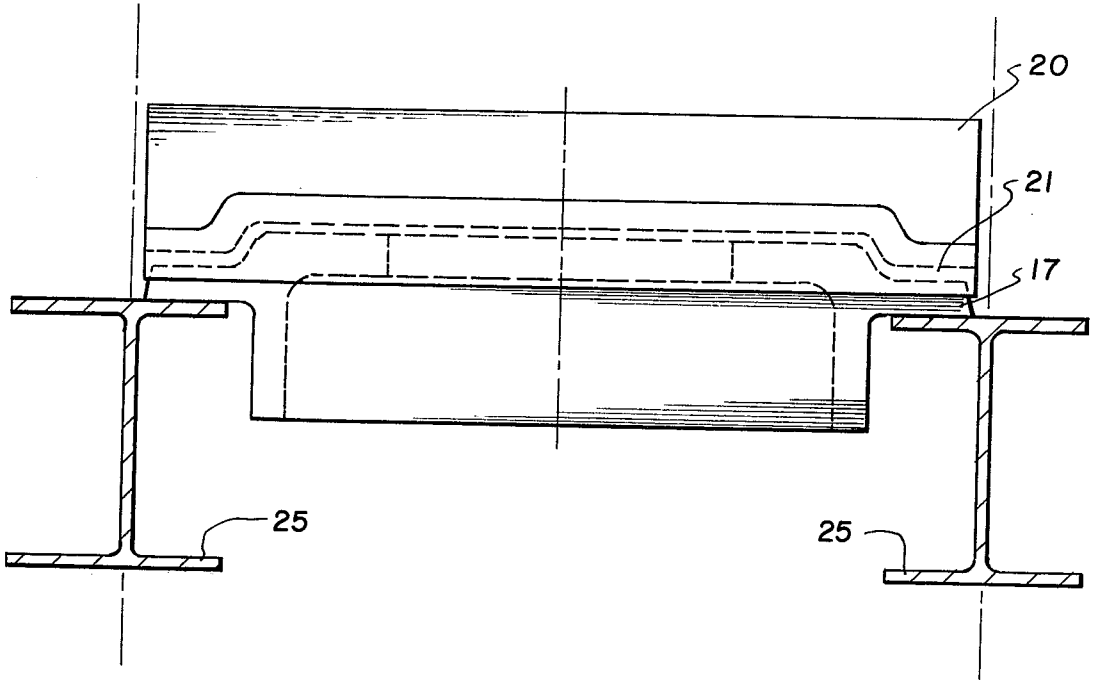
FIG. 4 is a partial rear elevational view of the door frame and the supports therefor.

FIG. 4 shows the arrangement of bridge 20 according to the invention with gasket cord 21 behind door frame 17 and the two buckstays 25. Bridge 20 and door frame 17 extend each from center to center of a heating wall.

While specific embodiments of the invention have been shown and described in detail to illustrate the application of the principles of the invention, it will be understood that the invention may be embodied otherwise without departing from such principles.

What is claimed is:

1. A device for sealing the chambers of coke ovens adjacent the roof of the ovens and above an oven door frame at the transition between fireclay brickwork and silica brickwork, each having joints between courses and with the door frame including an upper horizontal part and a vertical back part and which is located between buckstays supporting the side of the door frame, comprising a cast iron bridge extending horizontally between the buckstays and including a central vertical part disposed behind the vertical edge of the door frame and extending above the horizontal edge of the door frame and including an upper horizontal part connected to the central part and extending outwardly from one side thereof and underlying and supporting the fireclay brickwork above the transition of the fireclay brickwork and the silica brickwork and having a lower horizontal part extending outwardly from the side thereof having a lower horizontal extending part engaging into the silica brickwork between the joints thereof.

2. A device according to claim 1 including gasket means disposed between said cast iron bridge and the door frame.

3. A device according to claim 1 wherein said cast iron bridge includes at least one recess in the vertical portion thereof at a location where the vertical portion overlies the back portion of the door frame and an asbestos gasket in said recess.

4. A device according to claim 1 wherein said upper horizontal portion extends in a first direction and said lower horizontal portion extends in an opposite direction from said vertical central portion.

5. A device according to claim 1 including at least one T-girder arranged between courses of the outermost ones of the fireclay brickwork.

6. A device according to claim 1 including an angle iron located at the top of said fireclay brickwork and overlying said door frame.

7. A method of forming a furnace wall in which there are to be brickwork comprising silica brickwork and fireclay brickwork at distinct levels with a boundary therebetween comprising supporting the door frames on buckstays on each side thereof, positioning a cast iron bridge between the buckstays so that a back portion of the bridge overlies the back of the door frame and an upper horizontal portion of the bridge overlies the upper edge of the door frame, building the silica brickwork so that a portion of the bridge is engaged in a course thereof and constructing the fireclay brickwork above the horizontal portion of the bridge so that at least a portion thereof is supported thereon.

8. A method according to claim 7 including embedding at least one T-girder in a joint between courses of the fireclay brickwork.

9. A method according to claim 7 including positioning an angle iron at the top of the uppermost course of the fireclay brickwork and along the edge of the fireclay brickwork.

* * * * *